US006941764B2

(12) United States Patent
Leroy et al.

(10) Patent No.: US 6,941,764 B2
(45) Date of Patent: Sep. 13, 2005

(54) PROCESS FOR KEEPING CHILLED THE FOOD ON BOARD AIRCRAFT AND MEANS FOR IMPLEMENTING

(75) Inventors: Luc Leroy, Toulouse (FR); Bruno Alquier, Blagnac (FR); Bertrand Halphen, Coulommiers (FR); Roland Tevels, Saints (FR)

(73) Assignees: Airbus, Blagnac (FR); Zecools Zeolite Cooling Systme, Croissy Beaubourg (FR)

( * ) Notice: Subject to any disclaimer, the term of this patent is extended or adjusted under 35 U.S.C. 154(b) by 0 days.

(21) Appl. No.: 10/777,780

(22) Filed: Feb. 13, 2004

(65) Prior Publication Data

US 2004/0194487 A1 Oct. 7, 2004

(30) Foreign Application Priority Data

Feb. 17, 2003 (FR) ..... 0301881

(51) Int. Cl.[7] ..... F25D 15/00
(52) U.S. Cl. ..... 62/237; 239/430
(58) Field of Search ..... 62/237, 239, 269, 62/299, 430, 438, 476, 480

(56) References Cited

U.S. PATENT DOCUMENTS

| | | | | | |
|---|---|---|---|---|---|
| 3,906,744 | A | * | 9/1975 | Knapp et al. | 62/384 |
| 3,992,069 | A | * | 11/1976 | Kitterman | 312/244 |
| 5,038,581 | A | * | 8/1991 | Maier-Laxhuber et al. | 62/457.9 |
| 5,415,012 | A | * | 5/1995 | Maier-Laxhuber et al. | 62/269 |
| 5,491,979 | A | * | 2/1996 | Kull et al. | 62/185 |
| 5,513,500 | A | * | 5/1996 | Fischer et al. | 62/239 |
| 5,975,202 | A | * | 11/1999 | Grandi | 165/48.1 |
| 6,055,996 | A | * | 5/2000 | Sprenger et al. | 134/133 |
| 6,106,084 | A | * | 8/2000 | Thogersen et al. | 312/306 |
| 6,220,338 | B1 | * | 4/2001 | Grandi | 165/48.1 |
| 6,295,829 | B1 | * | 10/2001 | Gibot | 62/371 |
| 6,359,268 | B1 | * | 3/2002 | Walter | 219/622 |
| 6,820,441 | B2 | * | 11/2004 | Maier-Laxhuber et al. | 62/480 |

FOREIGN PATENT DOCUMENTS

| | | | | |
|---|---|---|---|---|
| DE | 4308144 | | | 10/1994 |
| DE | 4438619 | | | 5/1996 |
| DE | 19721828 | A1 | * | 12/1998 |
| FR | 2666141 | | | 2/1992 |
| FR | 2756912 | | | 6/1998 |
| FR | 2766262 | | | 1/1999 |
| FR | 2774748 | | | 8/1999 |
| FR | 2820196 | | | 8/2002 |
| JP | 2001349918 | A | * | 12/2001 |
| JP | 2002078535 | A | * | 3/2002 |

* cited by examiner

*Primary Examiner*—Mohammad M. Ali
(74) *Attorney, Agent, or Firm*—Stevens, Davis, Miller & Mosher, LLP

(57) ABSTRACT

Refrigerated trolley for an aircraft.

According to the invention:

each trolley (1) is equipped with a removable unit (11) that can be inserted in and removed from said trolley (1) as a single piece and that can produce cold inside the trolley, because said removable unit (11) has at least one controllable reversible solid/gas adsorption reactor containing a regeneratable adsorbent; and means for regenerating said adsorbent are provided on the ground, outside said aircraft.

14 Claims, 4 Drawing Sheets

PROCESS FOR KEEPING CHILLED THE FOOD ON BOARD AIRCRAFT AND MEANS FOR IMPLEMENTING

The present invention relates to trolleys for aircraft.

It is known that food for the passengers and crew on an aircraft is prepared, on the ground, in a laboratory and placed on individual serving trays. These serving trays are themselves placed in insulated serving trolleys which have shelves and which are stored, with the door open, in a refrigeration installation adjoining said laboratory. Thus, said food is kept chilled while awaiting delivery on board.

When said food is to be loaded on board an aircraft, said trolleys are taken from said refrigeration installation, their doors are closed, and they are transferred on board said aircraft where they are placed in storage compartments in the galley. Naturally, in particular on long flights, the galley itself has a refrigeration unit so that the food is preserved properly. Then, when it is time for the meal to be served, the trolleys are taken from the galley, their doors are opened, and some of the food is removed to be heated in an on-board oven. After the food thus heated has been replaced on the trays, the trolleys are moved, with their doors open, between the rows of seats on the aircraft to distribute the trays to the passengers.

From the foregoing it is immediately obvious that such a procedure presents the following disadvantages:

- even if insulated trucks are used to transfer the trolleys between the laboratory's refrigeration installation and the galleys of the aircraft, this still entails a break in the cold chain for said food; and
- the galleys must be equipped with an on-board refrigeration unit, which consumes electricity and is of considerable mass.

The object of the present invention is to overcome these drawbacks by ensuring an uninterrupted cold chain for said food while dispensing with the on-board refrigeration unit, which yields savings in terms of mass, costs, and electricity consumption on board.

To this end, according to the invention, the process for keeping chilled the food inside insulated trolleys used on board aircraft is noteworthy in that:

- each trolley is equipped with a removable unit that can be inserted in and removed from said trolley as a single piece and that can produce cold inside the trolley, because said removable unit has at least one controllable reversible solid/gas adsorption reactor containing a regeneratable adsorbent; and
- means for regenerating said adsorbent are provided on the ground, outside said aircraft.

Thus, by activating said reactors while the trolleys are still inside the laboratory refrigeration installation, said trolleys can be transferred on board aircraft without interrupting, the cold chain. Furthermore, because each trolley is associated with at least one reactor, whose adsorbent can be easily regenerated from outside the aircraft—thus rendering the trolley independent as regards refrigeration—it is possible to dispense with said refrigeration unit in the galley on board the aircraft.

It will be noted that reactors using adsorbents, such as zeolite, are well known in the art. They have a chamber containing said adsorbent, a reservoir containing a liquid, such as water, whose vapor can be adsorbed by said adsorbent, and a controllable communication between said chamber and said reservoir. They work under partial pressures of between 0.5 millibar and several hundred millibar. While the communication between the chamber and the reservoir is closed, the reactor is switched off. However, once said communication is open, liquid in the reservoir evaporates, cooling said reservoir, and the vapor from said liquid is adsorbed by said adsorbent, heating said chamber. When said adsorbent is saturated with liquid, the above-described process for producing cold in the reservoir and producing heat in said chamber, comes to a halt. Thus, it is then necessary to regenerate the adsorbent, generally by heating at temperatures between 200° C. and 350° C. Naturally, this regeneration of the adsorbent may take place before said adsorbent is completely saturated with the liquid.

It will be noted that, because said adsorbent-containing units are detachable from said trolleys, only these units are sent to said regeneration means, reducing the volume of the premises or stations containing these means. Moreover, while the reactor(s) of said units is (are) being regenerated, said trolleys, whether or not they are equipped with such a removable unit, may be loaded with food and/or stored in the laboratory refrigeration installation.

Preferably, use is made of a plurality of identical interchangeable trolleys and a plurality of interchangeable removable units. It is thus possible, at any time, to insert, in any trolley, a removable unit whose reactor(s) is (are) in operation, with a regenerated adsorbent. The problem of loading food on board aircraft is thus greatly facilitated, preventing aircraft from becoming grounded owing to a breakdown of the adsorption reactor for the trolleys.

In order to take full advantage of the present invention, there are provided, at least at some of the stopovers made by the aircraft, identical interchangeable trolleys, interchangeable removable units, and means for regenerating said adsorbent.

Thus, in order to implement the process according to the present invention, said trolley comprises means for receiving such a removable unit, said unit having retention means which can cooperate with said reception means on the trolley so that it can be inserted in and removed from said trolley as a single piece.

Said reception means on the trolley and said means for retaining the removable unit may be in a number of forms allowing said removable unit to interact with said trolley, for example in the manner of a nestable or folding cover. However, in a preferred embodiment of the present invention, said reception means on the trolley are of the drawer slideway type while said means for retaining the removable unit are of the slide type. Thus, said removable unit may be inserted in and removed from said trolley like a drawer.

In an advantageous embodiment, said removable unit comprises a thermally insulating base plate bearing, on one side, said chamber containing the adsorbent and, on the other side, said reservoir containing the liquid, said controllable communication between said chamber and said reservoir running from one side of said base plate to the other. In this case, it is particularly advantageous for said base plate to bear said retention means able to cooperate with said reception means on the trolley. If, moreover, the movable unit fits onto the trolley in the manner of a drawer, said base plate has two parallel opposite edges forming a slide which can cooperate with said slideways on the trolley.

To facilitate regeneration of the adsorbent, said removable unit may comprise at least one electrical resistance heating element, placed for example in said chamber containing the adsorbent. Thus, said regeneration means outside the aircraft need then only have electrical power sources suitable for powering said electrical resistors of said removable units.

Consequently, the stations for regenerating the adsorbent are particularly simple.

As a variant, said adsorbent regeneration means may comprise at least one oven. For example, in the case where said removable unit includes the thermally insulating base plate described above, said oven may be an open oven closed by said base plate, so that only said chamber containing the adsorbent is heated by said oven, the reservoir of said removable unit being shielded from the heat of the oven by said base plate. Said open oven may be elongate and means may be provided for moving said removable unit from one end of said oven to the other while said adsorbent is regenerated. It is thus possible to regenerate a plurality of removable units on a continuous basis.

Furthermore, it is advantageous for said regeneration means to include means for cooling said reservoir while said adsorbent is regenerated by heating.

The figures of the attached drawing will explain how the invention may be implemented. In these figures, identical reference numerals denote similar elements.

Figure 9:
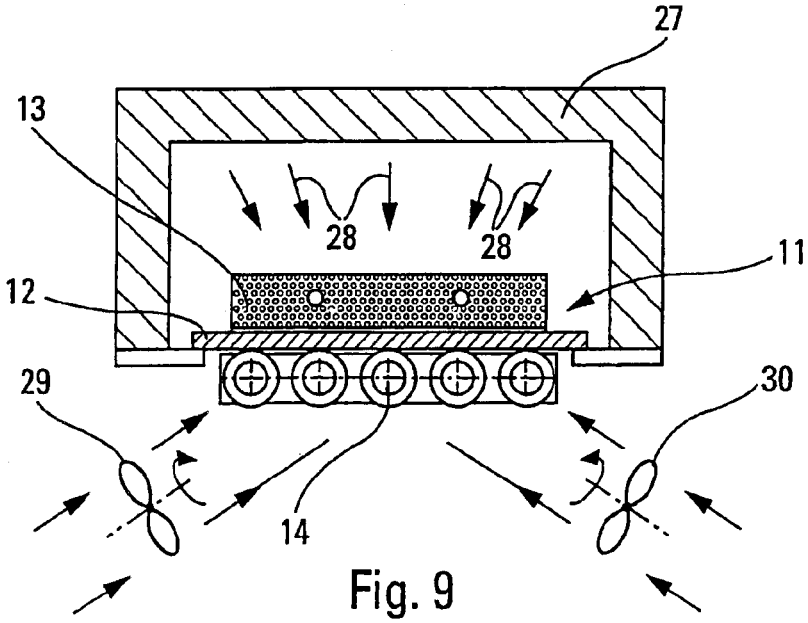

FIG. 9 diagrammatically illustrates means for regenerating the adsorbent of said cold-producing unit.

Figure 1:
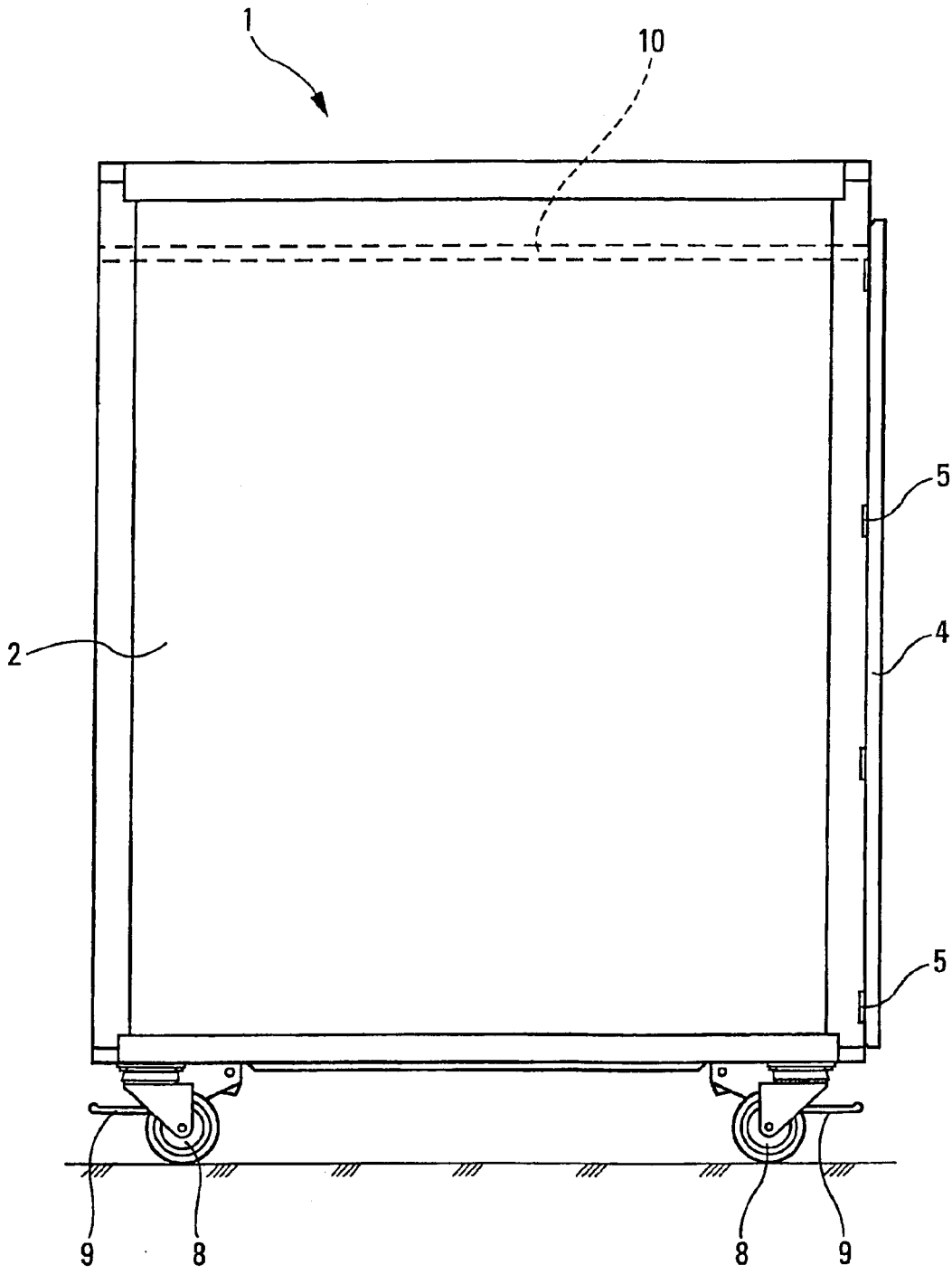
FIG. 1 is a view in side elevation of an exemplary embodiment of a trolley according to the present invention, the door of said trolley being closed.
Figure 2:
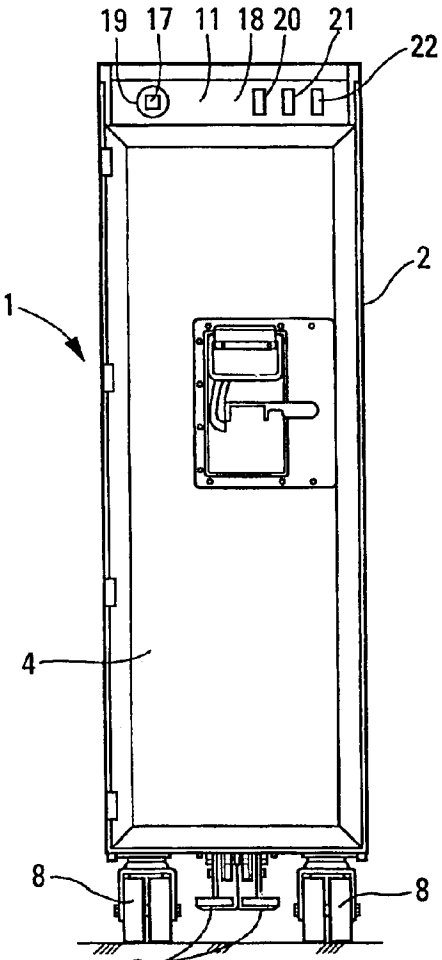
FIG. 2 is a front view of the trolley of FIG. 1 provided with a removable unit for producing cold, the door of said trolley being closed.
Figure 5:
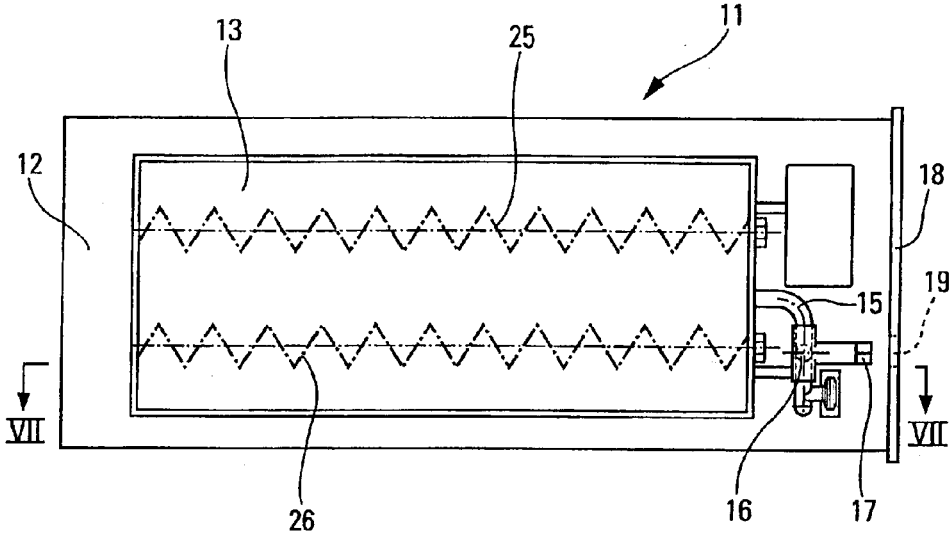
FIG. 5 is a view from above of said removable cold-producing unit.
Figure 6:
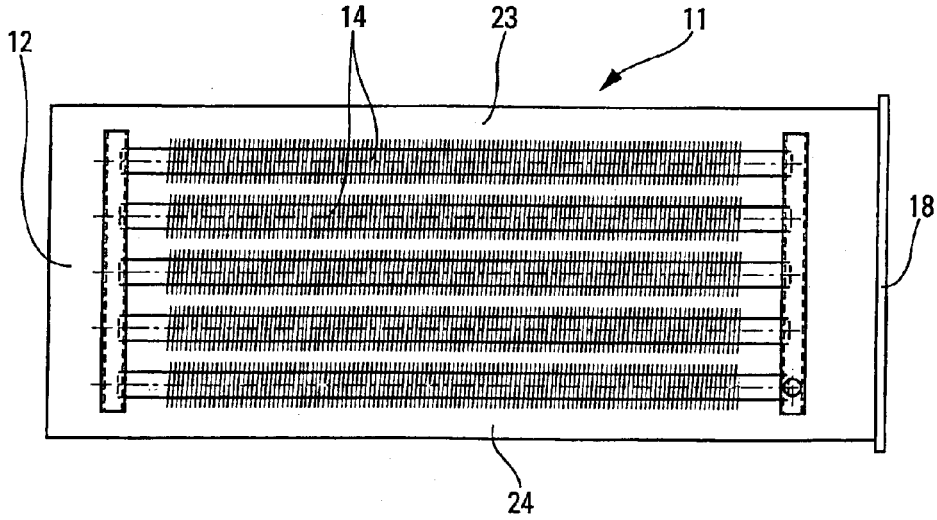
FIG. 6 is a view from below of said removable cold-producing unit.
Figure 7:
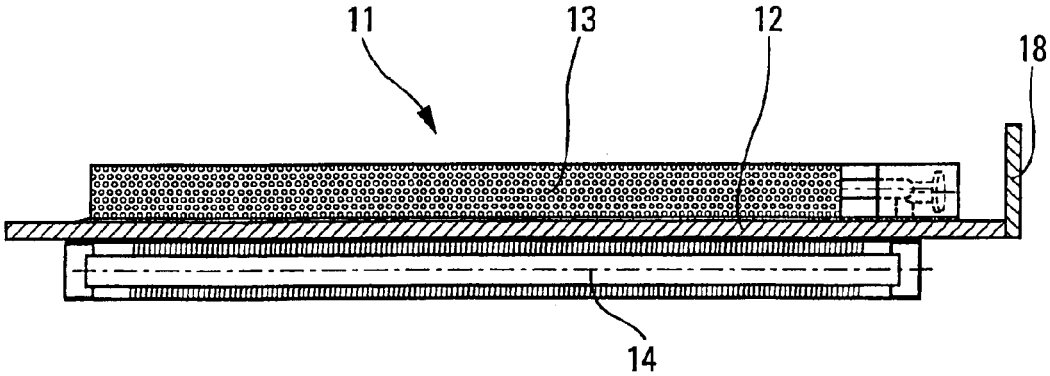
FIG. 7 is a longitudinal section on line VII—VII of FIG. 5.
Figure 8:
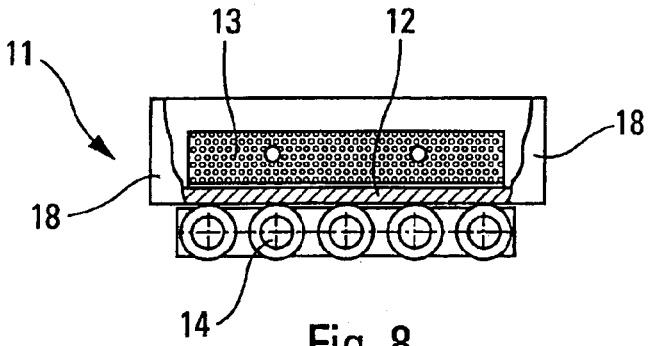
FIG. 8 is a front view, with the front face cut away, of the movable unit of FIGS. 5 to 7.

The trolley 1, according to the present invention and as depicted in FIGS. 1 and 2, is, as is usual, of transversely flat parallelepipedal shape. It has a thermally insulating casing 2, delimiting an internal volume 3, which can be closed by a front door 4. The door 4 is articulated on hinges 5, allowing it to be folded back against an external side face of the casing 2 when in the open position (see FIGS. 3 and 4).

Figure 4:
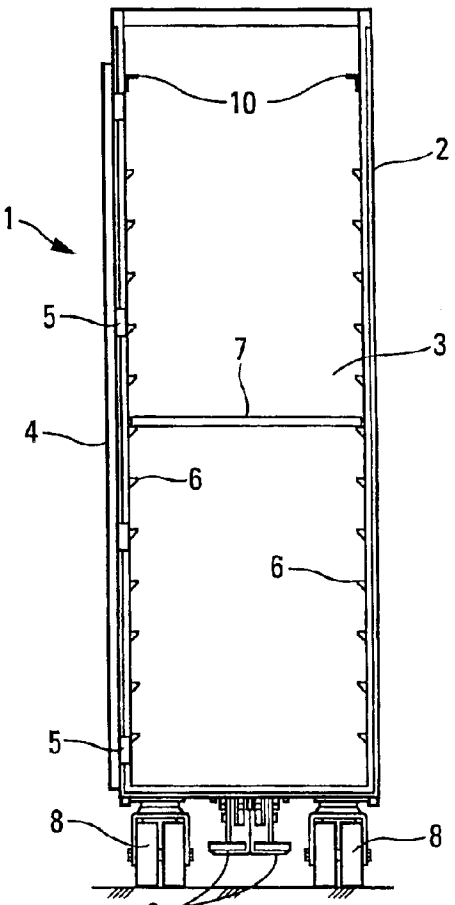
FIG. 4 is a view similar to FIG. 3, said removable cold-producing unit having been taken out of the trolley.
Figure 3:
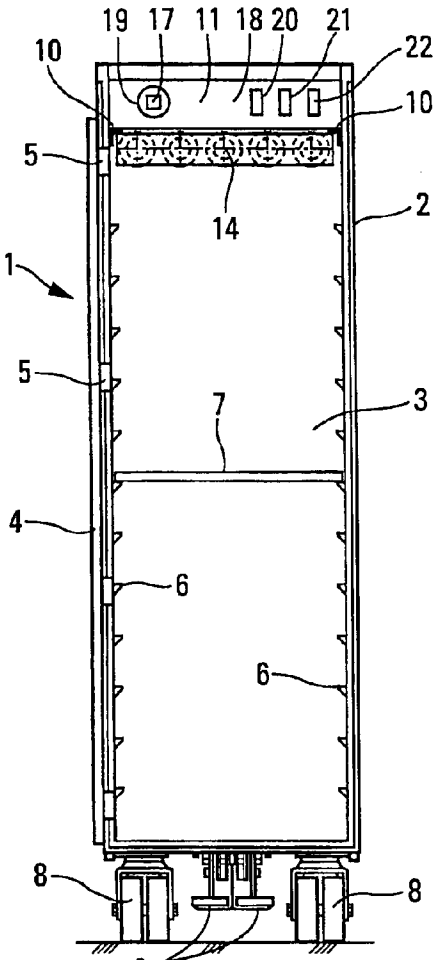
FIG. 3 is a front view of the trolley of FIG. 1 provided with said removable cold-producing unit, the door of said trolley being open and folded back against a side face of said trolley.

The internal volume 3 is equipped with slideways 6, fixed to the opposing internal side faces of said casing 2, for supporting and guiding trays 7, only one of which is depicted in FIGS. 3 and 4.

At the front and back, the trolley 1 also has wheel systems 8, which carry the casing 2 and which can be locked in terms of rotation by pedals 9.

In its upper part, the internal volume 3 additionally has two facing slideways 10 for a removable drawer 11, shown in FIGS. 5 to 8 and visible in FIGS. 2 and 3.

Said drawer 11 has a rectangular, thermally insulating base plate 12, made for example of carbon fibers. The upper face of the base plate 12 bears a chamber 13 containing a solid adsorbent such as zeolite. The lower face of said base plate 12 bears a reservoir 14 containing a liquid, for example water, whose vapor can be adsorbed by said adsorbent. As shown in the figures, the reservoir 14 may be in the form of an arrangement of parallel tubes, connected to end manifolds and provided with evaporator fins. A communication 15 runs between the chamber 13 and the reservoir 14, passing through said base plate 12, which communication can be controlled by a valve 16. The valve 16 can be opened and closed by a rotating endpiece 17, of square cross section for example.

Furthermore, said chamber 13 and said reservoir 14 may be placed under partial vacuum using means which have not been shown.

Thus, said drawer 11 forms a removable unit with a reactor which can produce cold by reversible solid/gas adsorption.

At its front end, the drawer 11 forms a facade 18, borne by said base plate 12 and orthogonal to the latter. In line with the rotating endpiece 17, said facade 18 has an aperture 19 for a key (not shown) to be inserted from the outside to operate said rotating endpiece 17. On the front face 18 there are also indicators 20, 21, 22, etc. to provide information on some reactor parameters such as the level of water in the reservoir 14 (this level is of course indicative of the degree of saturation of the adsorbent in the chamber 13), the pressure in the reactor, etc.

The drawer 11, which is depicted on its own in FIGS. 5 to 8, can be inserted in (and removed from) the internal volume 3 of the trolley 1 in such a way that the longitudinal edges 23 and 24 of the lower face of the base plate 12 rest and slide on the slideways 10. In its position of nominal insertion, which can be indicated by a controllable locking device (not shown), the facade 18 of the drawer 11 is flush with the door 4 opening frame, with its upper part (including the aperture 19 and the indicators 20 and 21) above said door 4 and its lower part below the latter (see FIGS. 2 and 3). Thus, when the door 4 is closed (FIG. 2), the upper part of said door bears against the lower part of the facade 18 of the drawer 11. In this position of nominal insertion, the evaporator-reservoir 14 is thus inside the internal volume 3, whereas the chamber 13 is outside said volume.

From the above it is obvious that, at aircraft stopovers, or at least at some of them, a plurality of trolleys 1 and a plurality of drawers 11 may be provided. The food prepared by the stopover laboratory may be put on trays 7, which are themselves placed on the shelves 6 of the trolley 1, the trolleys being stored in a refrigeration installation with (or without) a drawer 11 inserted in their enclosure 3. When it is time for said trolleys 1 to be transferred to the aircraft, they are equipped (if this has not already been done) with drawers 11 in working order—i.e. the adsorbent in the chamber 13 is dry, the level of liquid in the reservoir 14 is correct and the pressure inside the reactor is sufficiently low—and, while they are still inside said refrigeration installation, the valves 16 are opened by introducing a key in the apertures 19 to turn the-rotating endpieces 17. The reactors 13 to 16 then produce cold in the internal volumes 3 before the trolleys 1 even leave said refrigeration installation. They continue to do so as the trolleys are transferred to the airplanes and while the trolleys are stored in the galley. There is therefore no possibility of interruption in the cold chain for the food in the trolleys and no refrigeration unit is needed on board the aircraft to keep the inside of the trolleys cold.

It will be noted that, when in operation, the reactors 13 to 16 generate heat in the chambers 13 outside the internal volume 3 of the trolleys 1. This heat is prevented from passing into said internal volume 3 by the base plates 12. It is moreover dissipated outward, either by natural dissipation or forced dissipation, for example using fan means (not shown).

Advantageously, at each stopover in question, the number of drawers 11 is greater than the number of trolleys 1 so that, with drawers 11 being unavailable owing to adsorbent regeneration and/or breakdowns, each trolley 1 needing to be used can be equipped with a drawer 11 in working order.

In order to regenerate the adsorbent in the chamber 13, resistance heating elements 25, 26, may be provided in said chamber. In this case, the regeneration stations provided on the ground, outside the aircraft, need only have electrical voltage sources suitable for powering said resistance heating elements 25, 26.

As illustrated in FIG. 9, these regeneration stations may also include a bell oven 27, in which said drawers 11 are supported by the edges of their base plate 12, which closes said oven. Thus, the chamber 13 containing the adsorbent is heated by the oven 27 (arrows 28) while the reservoir 14 is shielded from the heat by said base plate 12. Fans 29, 30 may also be provided to ventilate said reservoir 14.

If the oven 27 is in the form of an elongate tunnel (orthogonal to the plane of FIG. 9), means (not shown) may be provided for moving the drawers 11 from one end of said oven 27 to the other while the adsorbent is regenerated.

What is claimed is:

1. An aircraft food chilling system comprising:

insulated trolleys for chilling food;

a removable unit, for each trolley, that can be inserted in and removed from the trolley as a single piece and that can produce cold inside the trolley, each removable unit having a controllable reversible solid/gas adsorption reactor containing a regeneratable adsorbent; and a means for regenerating the adsorbent, within the removable unit associated with each trolley, that is provided on the ground, outside the aircraft.

2. The system of claim 1, wherein the trolleys are identical and interchangeable and the removable units associated with the trolleys are identical and interchangeable.

3. The system of claim 2, further comprising a network of aircraft stopover facilities providing the regenerating means.

4. The system of claim 1 wherein each trolley comprises a means for receiving the associated removable unit.

5. The system of claim 4, wherein the reception means is of a drawer slideway type.

6. The system of claim 4, wherein each removable unit comprises a retention means for cooperating with the reception means on the associated trolley so that the removable unit may be removably fastened within the trolley.

7. The system of claim 6, wherein:

the reception means is of a drawer slideway type; and the retention means is of a slide type and cooperates with the slideway of the corresponding reception means.

8. The system of claim 6, wherein:

the reactor of each removable unit comprises a chamber containing the adsorbent, a reservoir containing a liquid whose vapor can be adsorbed by the adsorbent, and a controllable communication between the chamber and the reservoir;

the reservoir comprises a thermally insulating base plate, on opposite sides of which are arranged the chamber and the reservoir; and the controllable communication runs from one side of the base plate to the other.

9. The system of claim 8, wherein the base plate bears the retention means.

10. The system of claim 8, wherein:

the reception means is of a drawer slideway type; and the base plate has two parallel opposite edges forming a slide that cooperates with the slideway of the associated trolley's reception means, such that the removable unit may be inserted in and removed from the trolley as a drawer.

11. The system of claim 6, wherein:

the adsorbent may be regenerated by heating; and each removable unit comprises an electrical resistor for regenerating the adsorbent by heating.

12. The system of claim 8, wherein:

the adsorbent may be regenerated by heating; and the regenerating means comprises an open oven, which is closed by the base plate of a removable unit inserted for regeneration so that only the chamber containing the adsorbent is heated by the oven and the reservoir is shielded from the heat of the oven by the base plate.

13. The system of claim 12, further comprising a means for cooling the reservoir of the removable unit whose adsorbent is undergoing regeneration within the oven.

14. The system of claim 12, wherein the open oven is elongate and comprises a means for moving the removable unit undergoing regeneration from one end of the oven to the other while the adsorbent is regenerated.

* * * * *